US008684854B2

(12) United States Patent
Fisher

(10) Patent No.: US 8,684,854 B2
(45) Date of Patent: Apr. 1, 2014

(54) SUSPENDED FLYING RIG SYSTEM

(75) Inventor: Scott Fisher, Las Vegas, NV (US)

(73) Assignee: Tait Towers Manufacturing, LLC, Lititz, PA (US)

( * ) Notice: Subject to any disclaimer, the term of this patent is extended or adjusted under 35 U.S.C. 154(b) by 221 days.

(21) Appl. No.: 13/285,318

(22) Filed: Oct. 31, 2011

(65) Prior Publication Data

US 2013/0109484 A1 May 2, 2013

(51) Int. Cl.
*A63J 5/02* (2006.01)
*A63G 31/16* (2006.01)

(52) U.S. Cl.
USPC ..... 472/80; 472/130

(58) Field of Classification Search
USPC ..... 472/49–50, 59, 75–78, 80, 130; 434/29, 434/55; 104/112–113, 117, 117.1; 105/30, 105/148, 150–151
See application file for complete search history.

(56) References Cited

U.S. PATENT DOCUMENTS

| | | | | |
|---|---|---|---|---|
| 6,126,552 | A * | 10/2000 | Harrap | 472/130 |
| 6,497,623 | B2 * | 12/2002 | Mirfin et al. | 472/131 |
| 6,511,381 | B1 * | 1/2003 | Cochron | 472/46 |
| 6,695,291 | B2 * | 2/2004 | Kleimeyer et al. | 254/266 |
| 7,624,684 | B2 * | 12/2009 | Morris | 104/112 |
| 8,147,344 | B2 * | 4/2012 | Crawford et al. | 472/59 |

* cited by examiner

*Primary Examiner* — Kien Nguyen
(74) *Attorney, Agent, or Firm* — McNees Wallace & Nurick LLC

(57) ABSTRACT

A flying rig system includes a load guidance apparatus and at least two first positioning devices operatively connected to the load guidance apparatus to control the areal position of the load guidance apparatus within an upper portion of a working space. A second positioning device is operatively connected to the load guidance apparatus to permit selective vertical positioning of a load suspended from the load guidance apparatus substantially beneath the upper portion of the working space.

21 Claims, 6 Drawing Sheets

SUSPENDED FLYING RIG SYSTEM

FIELD OF THE INVENTION

The disclosure is generally related to a suspended flying rig system and method for operating a flying rig. More particularly, the disclosure includes a system and method for positioning and orienting a load, particularly within a working space.

BACKGROUND OF THE INVENTION

A motion providing device known in the art is a simulator-type apparatus that utilizes hydraulic cylinders to provide an upward force on a triangular support. The triangular support, in turn, typically supports a load. The cylinders provide force at angles which, when operating cooperatively, provide a range of motion for the support and the load mounted thereon. Other devices, such as hexapods and Stewart Platform devices operate in a similar manner However, these devices have a limited range of motion that is limited by the stroke of the hydraulic cylinder. Larger ranges of motion require larger hydraulic cylinders, which are expensive and more difficult to operate. In addition, hydraulic systems are expensive and require frequent maintenance.

Another motion providing device includes suspended camera rigs wherein a camera is suspended from four cables at opposing corners of an area. The cables are drawn and retracted by winches to provide a motion of the camera. The motion of the camera by use of these cables is limited to (x, y, z-type) positioning within the space and cannot provide roll, pitch or yaw of the camera. In addition, while it may be possible to move the camera to a desired x, y, z position within the area, the only way to ensure the desired range of movement of the camera within the area is achievable is to also remove all obstacles within the x, y, z spacial area. Removal of all obstacles is required in order to provide clearance for the supporting cables, greatly complicating its use, especially for theatric performances having multiple actors and props.

What is needed is a system and apparatus that provides a large range of positioning and/or orienting a load within a working space that does not suffer from the drawbacks of the prior art.

SUMMARY OF THE INVENTION

An aspect of embodiments of the present disclosure includes a suspended flying rig system and method for positioning and orienting a load within a working space using an arrangement of cables.

Another aspect includes a flying rig system having a load guidance apparatus and at least two first positioning devices operatively connected to the load guidance apparatus to control the areal position of the load guidance apparatus within an upper portion of a working space. A second positioning device is operatively connected to the load guidance apparatus to permit selective vertical positioning of a load suspended from the load guidance apparatus substantially beneath the upper portion of the working space.

Another aspect includes a method for positioning and orienting a load within a working space. The method further includes providing a load guidance apparatus. The method further includes connecting at least two first positioning devices to the load guidance apparatus to control the areal position of the load guidance apparatus within an upper portion of a working space. The method further includes connecting a second positioning device to the load guidance apparatus to permit selective vertical positioning of a load suspended from the load guidance apparatus beneath the upper portion of the working space.

An advantage of the present invention of the present disclosure includes a capability of selective combination of movement of a load in any combination of horizontal direction, vertical direction and lateral direction permitting positioning and orientation in three dimensions within a working space while limiting movement of a load guidance apparatus within an upper portion of the working space.

Another advantage of embodiments of the present disclosure includes capability of providing motion that allows pitching, yawing and rolling motion of a load.

Still another advantage of embodiments of the present disclosure include the ability to assemble the flying rig system in a variety of locations, with little space requirements for equipment.

Yet another advantage of embodiments of the present disclosure include the capability of providing a swinging motion of a load.

It is to be understood that one or more of the above-referenced advantages may be contained in an exemplary embodiment of the present invention.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
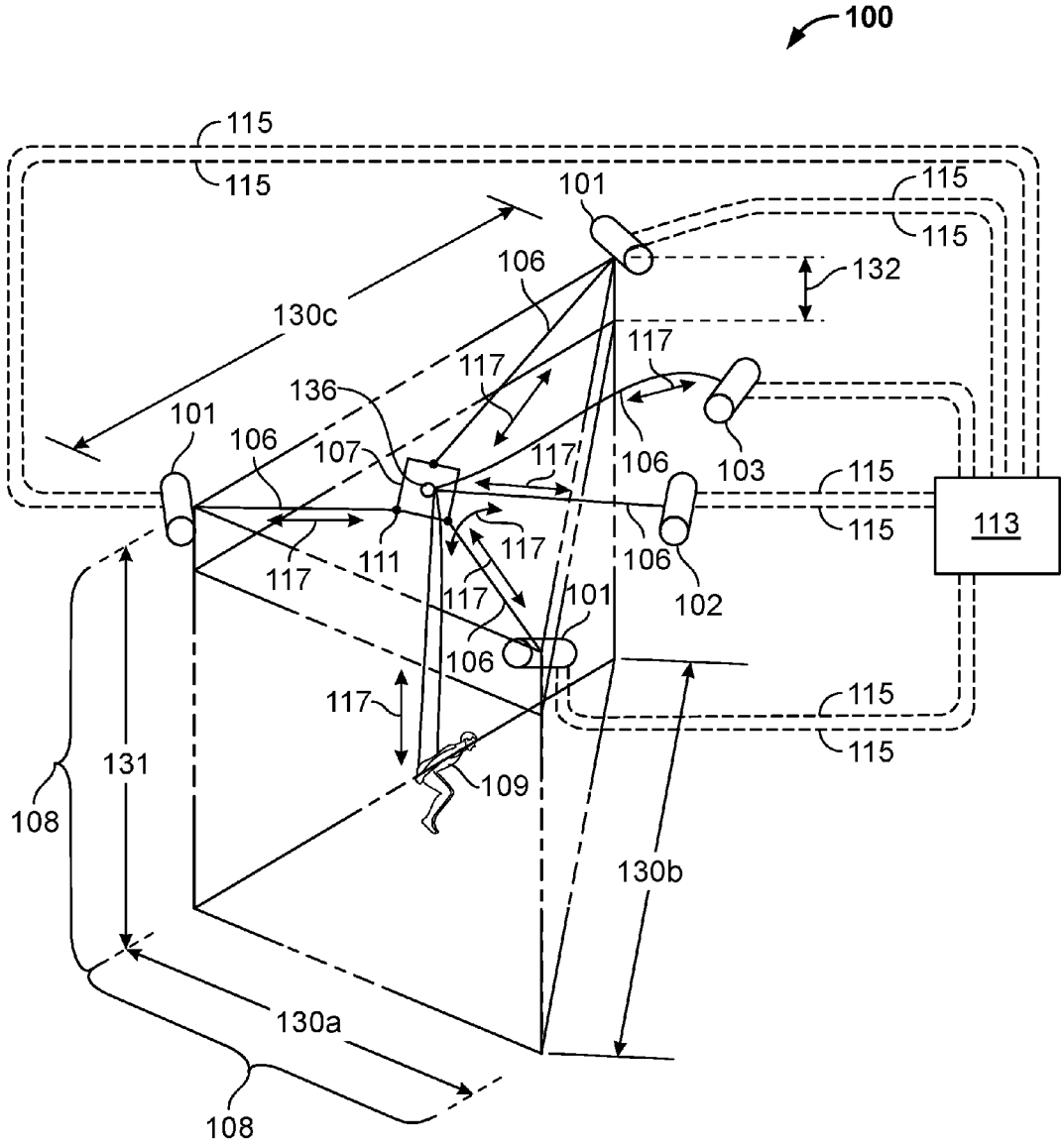
FIG. 1 shows an isometric view of a suspended flying rig system according to an exemplary embodiment of the disclosure.
Figure 2:
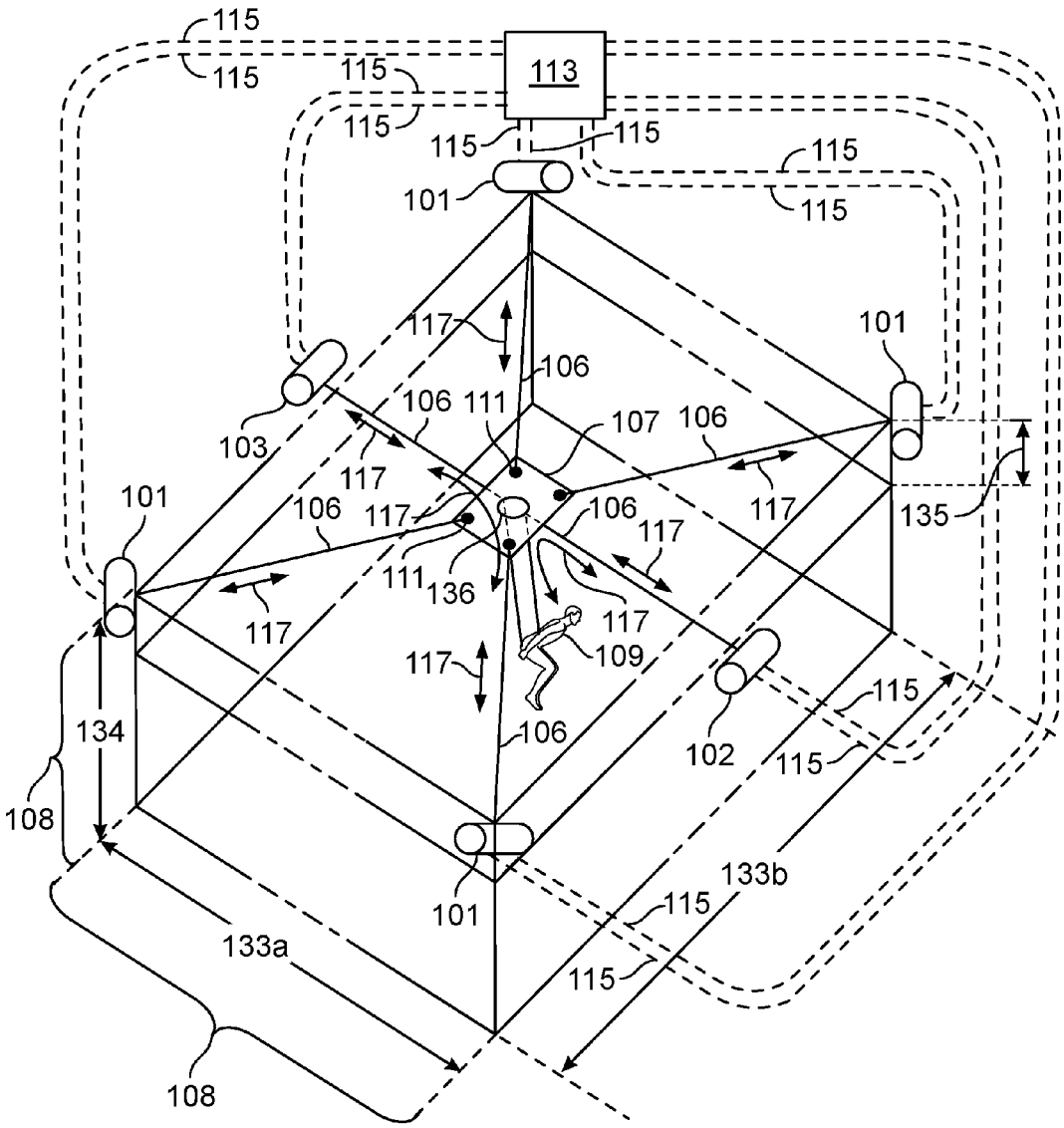
FIG. 2 shows an isometric view of a suspended flying rig system according to another exemplary embodiment of the disclosure.
Figure 3:
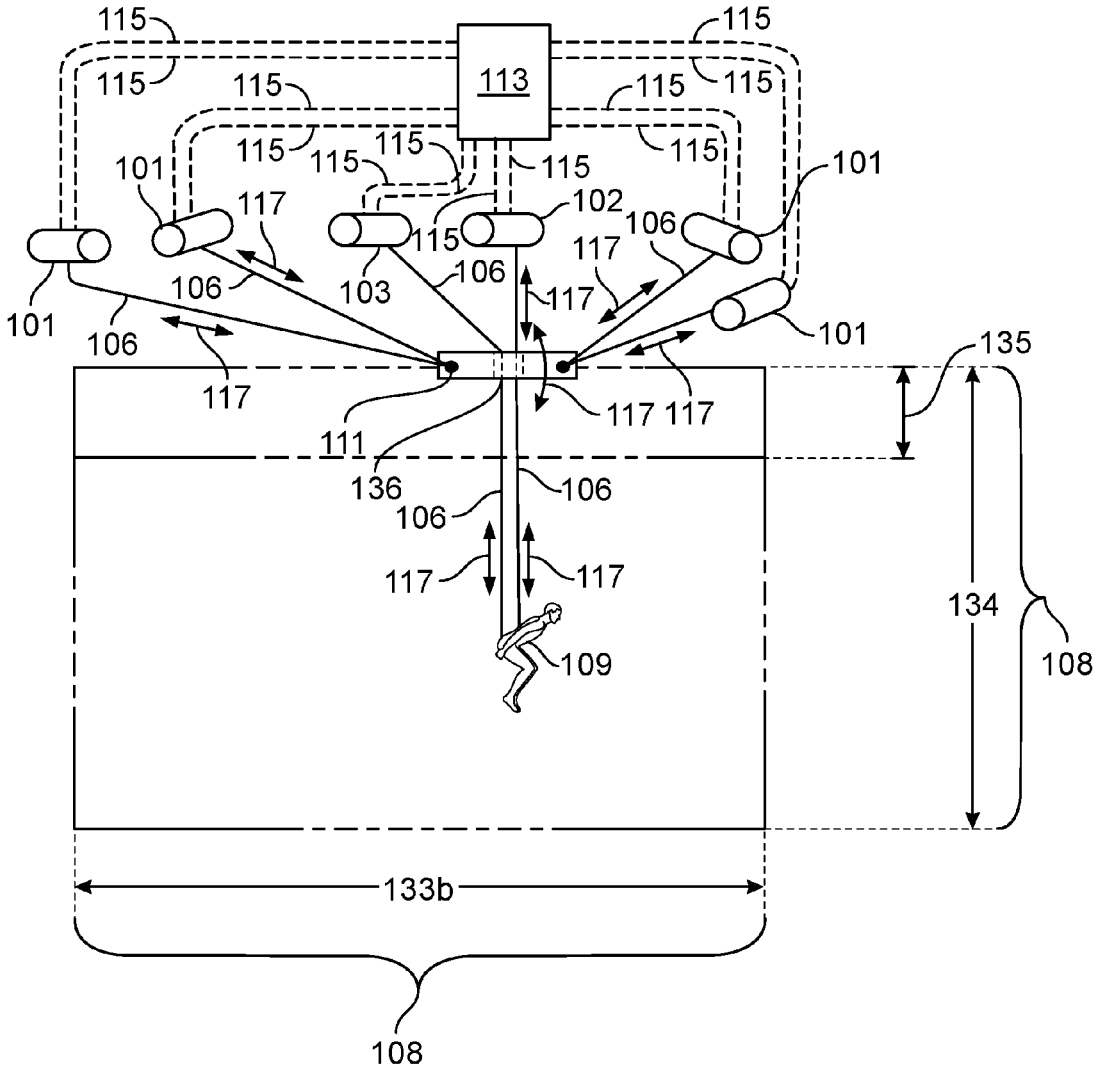
FIG. 3 shows a side view of a suspended flying rig system according to the exemplary embodiment of FIG. 2 of the disclosure.

FIG. 1-3 show a flying rig system 100 according to an embodiment of the present disclosure. The flying rig system 100 may be mounted to any suitable support structure. For example, a plurality of first, second and third positioning devices 101, 102, 103, such as respective winch assemblies, may be mounted to one or more support structures, such as a truss, ceiling structure, beam or other suitable support. The winch assemblies or first, second and third positioning devices 101, 102, 103 are operatively connected to support structure by any suitable mechanism. Suitable mechanisms include, but are not limited to, fasteners, interlocking structure, quick-release mechanisms, semi-permanent attachment devices, such as welds, or other attachment devices. The flying rig system 100 also includes a plurality of cables 106 extending from each of the winch assemblies or first, second and third positioning devices 101, 102, 103 to a load guidance apparatus 107.

Figure 5:
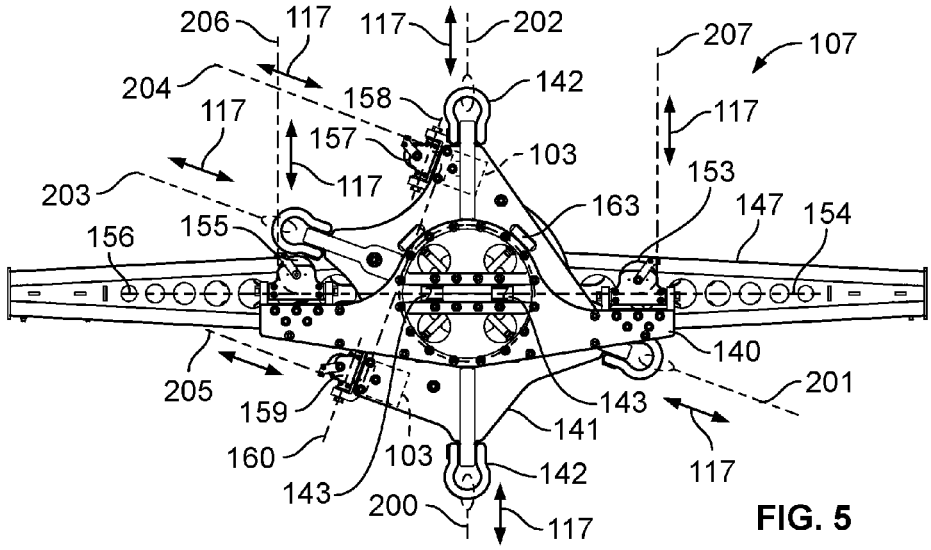
FIGS. 5-6 show different orthogonal views of an exemplary embodiment of a load guidance apparatus according to an exemplary embodiment of the disclosure.
Figure 6:
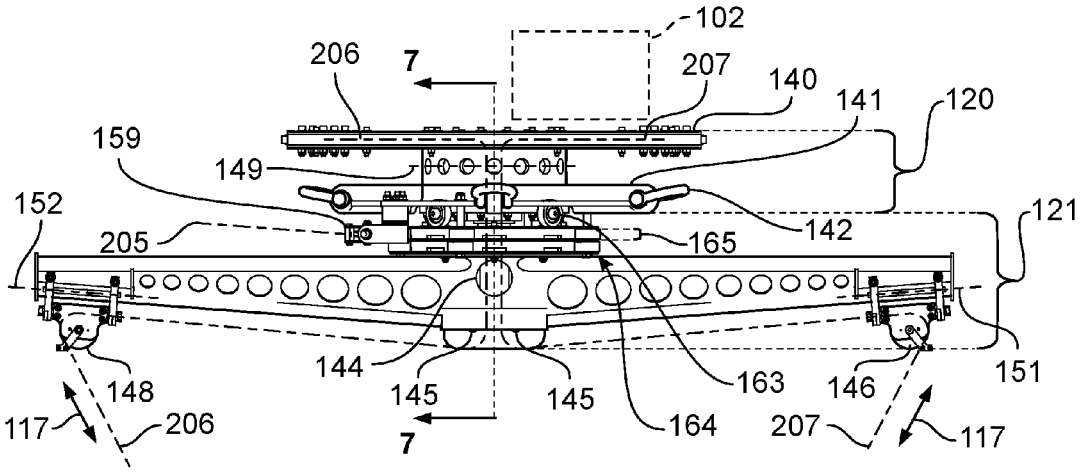

For assistance in understanding the invention of the present disclosure, winch assemblies or respective first, second and third positioning devices 101, 102, 103 may be utilized to position load guidance apparatus 107, provide primary lifting of load 109 and/or allow pitching, yawing and rolling motion of load 109. In another embodiment, the positioning devices may be arranged differently with respect to each other so that any combination of the positioning devices may be used to position and/or rotatably orient one or more of the load guidance apparatus and the load. In other words, the term positioning device, unless used to describe the operation of a specific embodiment, and/or disclose a specific function with respect to the system, may be interchangeably used herein to describe a source of tensile force applied to a cable as part of positioning/orienting a load in a working space, such as in a two dimensional working space or a three dimensional working space. In another embodiment, additional positioning devices may be used. As shown in FIGS. 1-3, first positioning devices 101 (three shown in FIG. 1; four shown in FIGS. 2-3) are used to control the areal position of load guidance apparatus 107 in a three dimensional working space 108. It is to be understood that in other embodiments, multiple second positioning devices, third positioning devices, etc., may also be used. It is also to be understood that in one embodiment, two first positioning devices may be used, such as with a planar or two dimensional working space. However, in another embodiment such as where at least one movable first positioning device may be used, the working space may be non-planar or three-dimensional working space. As further shown in FIG. 1, second positioning device 102 is used to be operatively connected to load guidance apparatus 107 to provide vertical positioning (raising/lowering) of load 109. In a further embodiment, such as shown in FIG. 6, second positioning device(s) 102 may optionally be secured directly to load guidance apparatus 107. As further shown in FIG. 5, for example, third positioning device(s) 103 may be directly connected to load guidance apparatus 107 and used to provide relative rotational movement between different portions of load guidance apparatus, resulting in selective control of yaw orientation or a yaw orientation angle of the load. Yaw, as applied to a load in the form of a person, would correspond to the direction the person would be facing while looking straight ahead (and standing substantially vertically, with respect to the three dimensional working space. In other words, for a person standing erect and facing forward and having an axis extending longitudinally through the person (a vertically oriented axis), movement in the yaw direction would conventionally correspond to a rotational movement about said vertical axis.

The exemplary embodiments disclose the positioning devices to be securely fixed to a suitable support structure, as previously discussed, such as to the support structure, and in another embodiment, the support structure being positioned near a top of a structure. However, in an alternate embodiment, one or more of the positioning devices may be movably positioned, such as being capable of controlled movement along a support structure, such as an I-beam or other suitable structure, if desired. In a further embodiment, instead of the positioning devices being positioned near a top of a structure, one or more of the positioning devices may be positioned at or near a bottom of the working space, for example, utilizing a pulley or other suitable member capable of movably altering the direction of cable that is positioned near the top of the structure, if desired.

As shown in FIGS. 1-3, load guidance apparatus 107 guides, supports, attaches to or otherwise interacts with a load 109. In certain embodiments, load 109 may include seating and a protective cage. However, the load mountable on or to the load guidance apparatus 107 is not so limited. For example, in other embodiments the load may include cameras, equipment, lighting, personnel, ride vehicles, ride cars or other objects that are desirably positioned and/or oriented.

As shown in FIGS. 1-3, load 109 is suspended from load guidance apparatus 107, which is moved by selective retraction and deploying of cable 106 from one or more winch assemblies or respective first, second and third positioning devices 101, 102, 103. By retraction, it is meant that cable 106 is drawn so that the length of cable 106 suspended or extending from the winch assembly or positioning device is shortened, such as being withdrawn inside the positioning device. By deployed, deploying or grammatical variations thereof, it is meant that cable 106 is extended so that the length of cable 106 suspended or extending from the winch assembly or positioning device is increased. The cable 106 is an elongate support device capable of supporting weight and being stored and driven on the winch assembly or positioning device. Suitable structures for use as cable 106 include, but are not limited to, a wire, cable, rope, tape or other structure capable of supporting weight. The cable 106 may be synthetic or non-synthetic material. Suitable materials for cable 106 may be a metal, polymer or other suitable high strength material of construction. For example, one or more cables may be constructed of a material referred to as TECHNORA, a registered trademark of Teinjin Techno Products Limited of Osaka, Japan. In other embodiments, the cable 106 includes power or signal wires either integrated into the cable 106, adjacent to the cable 106 or run parallel to the cable 106 in order to provide power and/or control to a camera or other devices present as or associated with the load. In one embodiment, one or more of the cables 106 are configured for transmitting signals (for example, through electrical signals) to the load guidance apparatus 107, particularly when power and/or control signals are desirable for use with the load guidance apparatus 107 or a load supported directly or indirectly by the load guidance apparatus. For example, in one embodiment, the cable(s) 106 include fiber-optic interiors with a durable exterior (for example, a flexible polymeric coating or a flexible metal coating). In one embodiment, one or more of the cables 106 includes an aramid fiber (for example, a polyimide fiber). In one embodiment, one or more of the cables 106 are steel cables and are of a sufficient gauge size capable of supporting an actor (flying performer) on a single cable. In another embodiment, one or more of the cables 106 are braided Kevlar-jacketed. KEVLAR is a registered trademark of E. I. du Pont de Nemours and Company of Wilmington, Del.

As shown or referenced in the figures, a suitable positioning device, which would include any of first, second and third positioning device(s) 101, 102, 103, such as a winch assembly, may be a powered winch or other device capable of retaining and retracting/deploying cable. As shown in FIG. 1, one embodiment of the disclosure includes a winch assembly or first, second and third positioning devices 101, 102, 103 being a powered winch having a motor, which drives a reel or set of reels which receive, store, drive or otherwise move cable 106. The arrangement of motors and reel can include any suitable arrangement known for powered winches and may include gearing, clutch assemblies, brakes, belts, chains or other structures useful for translating rotation motion from the motor to rotational motion of the reel. In one embodiment, the reel includes a helical groove or similar structure to retain and cable 106. One suitable winch includes a F515 Self-Contained Flying Winch available from Fisher Technical Services Inc., Las Vegas, Nev. Although the above has been described with respect to a motor and reel to move cable 106, other structures may be utilized to provide movement to cable 106. The amount or length of cable 106 that is suspended may be altered by other methods, such as non-rotation mechanical systems, hydraulic cylinders, or by other actuation devices capable of altering the amount of cable 106 that is suspended. For example, portions of the cable 106 may be folded or redirected to remove a portion of the length that is suspended from the support structure onto which first, second and third positioning devices 101, 102, 103, or components operatively connected to the positioning devices, such as pulleys or sheaves, are attached. Manipulation of the length of cable 106 suspended under tension facilitates motion of load guidance apparatus number 107 attached thereto at attachment points 111.

As shown in the figures, winch assemblies or first, second and third positioning devices 101, 102, 103 may be controlled by a controller 113 or control system. A suitable controller 113 or control system includes one or more microprocessors and graphical user interface that provides individual control to positioning devices in response to the desired motion of load guidance apparatus 107. Control lines 115 provide signals and/or power to the positioning devices. In one embodiment, the positioning devices include control systems having microprocessors that provide control to the positioning device and retract or deploy the cable 106 in response to a signal. In another embodiment, such as shown in FIG. 1, winch assemblies or first, second and third positioning devices 101, 102, 103 may receive power and/or signals from controller 113 to retract or deploy the cable 106. The arrangement of control lines 115 may include individually run cables to the winch assemblies or first, second and third positioning devices 101, 102, 103 or may include a daisy-chain arrangement wherein the line includes a single or few branches from which connections to the winch assemblies or first, second and third positioning devices 101, 102, 103 are made. The arrangement of the controller 113 may also be integrated into a large control system, such as a show or attraction where a graphical user interface and series of microprocessors are arranged to provide centralized control of the motion of load guidance apparatus 107.

While the above has been described with respect to winch assemblies or first, second and third positioning devices 101, 102, 103 being attached to the support structures, such as trusses, other structures may be utilized to guide and suspend cables 106. In another embodiment, one or more pulleys may be mounted to a single support structure. The pulleys may be arranged and mounted to support the cable 106 as it is deployed or retracted by the positioning devices. In another embodiment, the pulleys may be arranged within or on tracks or other guides that physically move their locations on the fly to provide dynamic re-sizing and re-shaping of the working space 108. Suitable sheaves or pulleys include conventional pulley structures or other devices capable of rollably or slidably supporting a cable, wire or rope. While the pulleys in an exemplary embodiment may be free-rolling pulleys, a brake, motor or other rotation facilitating or retarding device may be provided to pulleys to provide additional control for positioning the load guidance apparatus 107. In these embodiments, the winch assemblies or first, second and third positioning devices 101, 102, 103 may be located at a location some distance from the pulley. In one embodiment, the winch assemblies or positioning devices may be located at or near ground level. In another embodiment, a portion of the winch assemblies or positioning devices may be mounted at ground level and a portion of the winch assemblies or positioning devices may be mounted on a support structure and cables 106 run to the pulleys. In yet another embodiment, the winch assemblies or first, second and third positioning devices 101, 102, 103 may be consolidated into a single location and cables 106 run to the pulleys to allow shorter control lines 115 and easier servicing of the winch assemblies or positioning devices. The cable 106 is connected to the attachment points 111 on load guidance apparatus 107 by any suitable mechanism. Suitable mechanisms include, but are not limited to, loop and closed-hook mechanisms, such as shackles, connectors guided by magnets for alignment, bolts or other fasteners, and cable splices.

As shown in the figures, motion of load guidance apparatus 107 and load 109 is facilitated by deploying or retracting cables 106 along pull directions 117. Motions, such as pitch, roll and yaw of the load, can be provided by selectively retracting and deploying cable 106 with winch assemblies or first, second and third positioning devices 101, 102, 103. The motions result as the cables 106 are independently deployed or retracted, causing independent motion in each of the pull directions 117. In one embodiment, the cooperative motion in the pull directions permit a range of motion of load 109 in a three dimensional work space with at least six degrees of freedom. As shown in FIG. 1, other motions, such as vertical manipulation (raising/lowering) of the load, can be accomplished by selectively retracting cable 106 with winch assembly or second positioning device 102 operatively connected to load guidance apparatus 107, while simultaneously constraining movement of load guidance apparatus 107 by winch assembly or first positioning devices 101, as will be discussed in further detail below.

As shown in FIG. 1, load guidance apparatus 107 can be positioned within an upper portion 132 of an exemplary working space 108. Three dimensional working space or working space 108 includes a three dimensional space through which the load guidance apparatus 107 may be positioned. In another embodiment, a portion of load guidance apparatus 107 may be rotated with respect to another portion of the load guidance apparatus, such as to achieve a yaw orientation angle of load 109. FIG. 1 resembles a wedge, having perimeter sides 130*a*, 130*b*, 130*c* and a height 131, cumulatively defining three dimensional working space 108. As further shown in FIG. 1, three first positioning devices 101 are each operatively connected to load guidance apparatus 107 via an attachment point 111. As a result of deploying or retracting cables 106 along pull directions 117 associated with each first positioning device 101, the position of load guidance apparatus 107 is selectively controlled within the confines of perimeter sides 130*a*, 130*b*, 130*c* and within an upper portion 132 of working space 108. Stated another way, the areal position of load guidance apparatus 107 is selectively controlled within the working space 108, and simultaneously, the vertical position of the load guidance apparatus is also controlled so that the load guidance apparatus remains within an upper portion 132 of working space 108. In addition, load 109 is selectively suspended from load guidance apparatus 107, such as through an opening 136 formed in load guidance apparatus 107, substantially beneath upper portion 132 of working space 108. By virtue of the arrangement shown in FIG. 1, clearance issues normally associated with movement of a load within a three dimensional working space, such as with personnel or equipment, are significantly reduced, while maintaining multiple degrees of freedom with respect to positional/rotational control of the load. It is to be understood that in another embodiment, in which perimeter side 130*a* is zero, and one first positioning device 101 is removed, the working space may be a two-dimensional working space, but the system functioning in a similar manner as disclosed in FIG. 1.

As shown in FIGS. 2-3, load guidance apparatus 107 can be positioned within an upper portion 135 of an additional exemplary working space 108. Working space 108 includes a three dimensional space through which the load guidance apparatus 107 may be positioned. In another embodiment, a portion of load guidance apparatus 107 may be rotated with respect to another portion of the load guidance apparatus, such as to achieve a yaw orientation angle of load 109. FIGS. 2-3 resembles a rectangle, having opposed perimeter sides 133*a* and 133*b* and a height 134, cumulatively defining a three dimensional working space 108. As further shown in FIGS. 2-3, four first positioning devices 101 are each operatively connected to load guidance apparatus 107 via an attachment point 111. As a result of deploying or retracting cables 106 along pull directions 117 associated with each first positioning device 101, the position of load guidance apparatus 107 is selectively controlled within the confines of opposed perimeter sides 133*a* and 133*b* and within an upper portion 135 of working space 108. Stated another way, the areal position of load guidance apparatus 107 is selectively controlled within the working space 108, and simultaneously, the vertical position of the load guidance apparatus is also controlled so that the load guidance apparatus remains within an upper portion 135 of working space 108. In addition, load 109 is selectively suspended from load guidance apparatus 107 substantially beneath an upper portion 135 of working space 108. Similar to FIG. 1, by virtue of the arrangement shown in FIGS. 2, 3, clearance issues normally associated with movement of a load within a three dimensional working space, such as with personnel or equipment, are significantly reduced, while maintaining multiple degrees of freedom with respect to positional/rotational control of the load.

Although FIGS. 1-3 depict a general dimension for the working space, the disclosure is not limited to the locations shown in the figures and movement, positioning and orientation may occur outside the working space 108, particularly if external forces are provided or actions, such as swinging or cable manipulation, are utilized. In addition, the dimensions of working space 108 may be altered, for example, by placement of pulleys, movement of the support structure or movement of the positioning devices.

In an exemplary embodiment, the support structure may be mounted on rails or other movable assembly and configured to provide additional translational motion to the load guidance apparatus 107. For example, the working space 108 may be extended in this embodiment to include an extended space corresponding to the motion of the support structure. Likewise, the support structure may be rotated, lifted, lowered or otherwise moved to provide an additional range of motion to the load guidance apparatus 107 and an extension to the working space.

Figure 4:
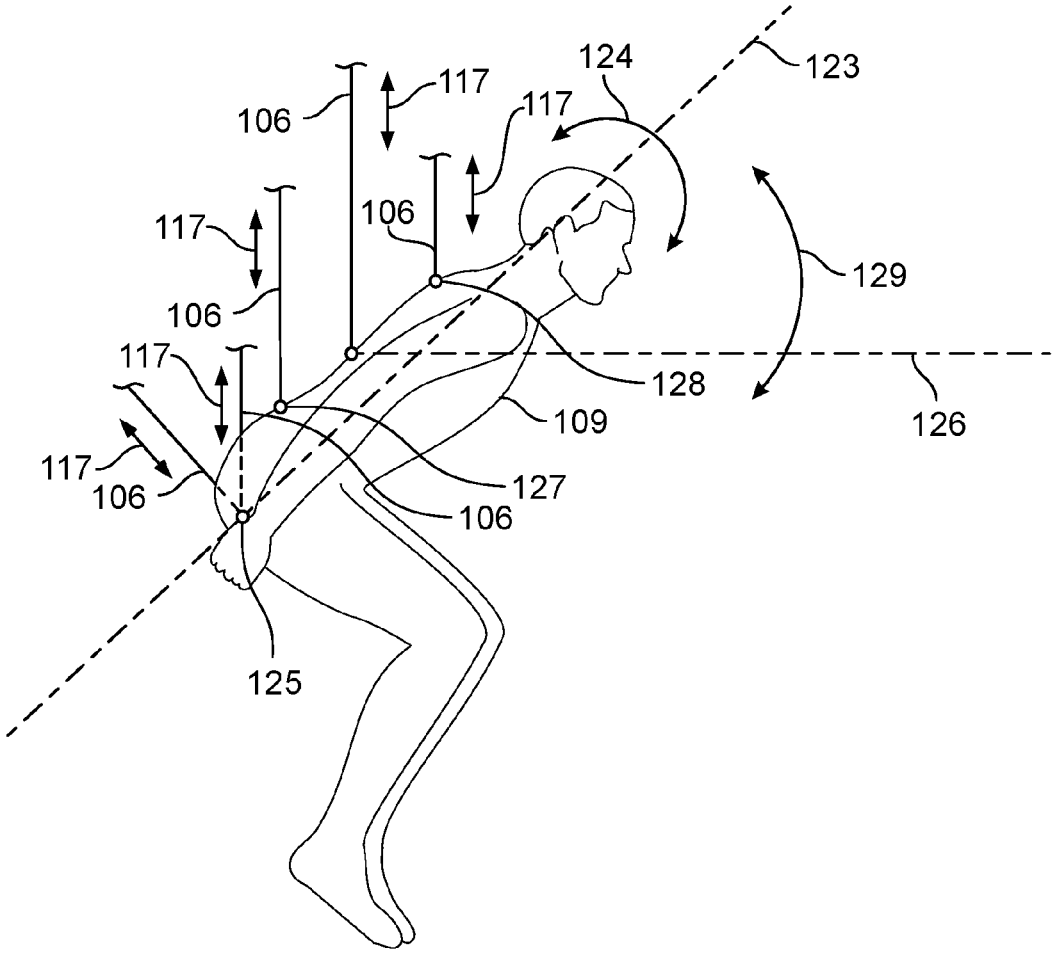
FIG. 4 shows the suspended flying rig system positioning and orienting a load according to an exemplary embodiment of the disclosure.

FIG. 4 shows a load 109 in the form of a person or mannequin. An axis 123 corresponds to a longitudinal portion of the upper torso of the person or load 109, which rotation about axis 123 being referred to as roll or a roll orientation angle 124 of load 109 with respect to axis 123. Stated another way, as further shown in FIG. 4, cables 106 having opposed hip attachment points to the person or load 109, such as to a suitable "flying harness" (not shown), by virtue of sufficiently uneven forces of pull directions 117 being applied to the cables 106 connected to the opposed hip attachment points 125, a rotational roll movement or a change to the roll orientation angle 124 of load 109 will result. In a similar fashion, for purposes of orienting and understanding the invention of the disclosure, and not intending to be limiting, a substantially horizontal axis 126 is provided. Attachment points 127, 128 located substantially along the spine of person or load 109 of a suitable flying harness are connected to corresponding cables 106. In response to a sufficient difference in forces between cables 106 connected to attachment points 127, 128, a rotational pitch movement or a change to the pitch orientation angle 129 with respect to axis 126 about an axis substantially parallel to hip attachment points 125 will result. Attachment points 127, 128 would typically not be required if load 109 is a person trained to use a suitable flying harness, as the trained person should normally be able to control his/her pitch orientation angle 129 without use of cables 106. However, such a cabled arrangement may be necessary if a mannequin or other inanimate object incapable of altering its center of gravity for purposes of controlling pitch rotational movement, or pitch orientation angle 129 is utilized, such as during a public performance.

FIGS. 5-11 show different views of an exemplary embodiment of load guidance apparatus 107. To assist in understanding the exemplary embodiment of the invention shown in FIGS. 5-11, the cables associated with positioning devices (not shown for clarity) will be referred to as 2XX cables, while the respective forces associated with each cable will continue to be referred to as pull direction 117. As shown, load guidance apparatus 107 includes a lift sheave assembly 140 (FIGS. 5, 6) separated from a base 141 (FIGS. 5, 6) by a spacer 149 (FIGS. 6, 7), collectively defining a first portion 120 (FIGS. 6, 7) of load guidance apparatus 107. As further shown in the figures, a roller assembly 163 (FIGS. 5, 6, 9) is positioned between first portion 120 and a second portion 121 (FIGS. 6, 7, 8), permitting relative rotational movement of first portion 120 with respect to second portion 121 about a common rotational axis, such as associated with tube 144 (FIG. 6, 7, 11) that extends through second portion 121 and into first portion 120. Second portion 121 includes a drum assembly 164 (FIGS. 6, 7, 11) having drum portions 165, 166. Drum assembly 164 is secured to an arm 147 (FIGS. 5, 6, 8-10).

Figure 7:
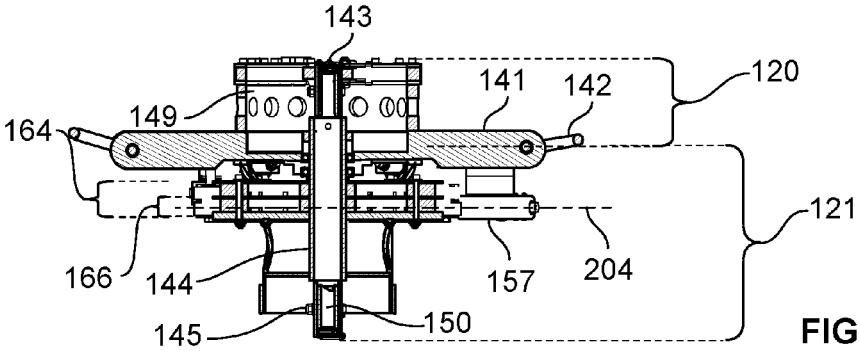
FIG. 7 shows a cross section of the load guidance apparatus taken along line 7-7 according to an exemplary embodiment of the disclosure.
Figure 8:
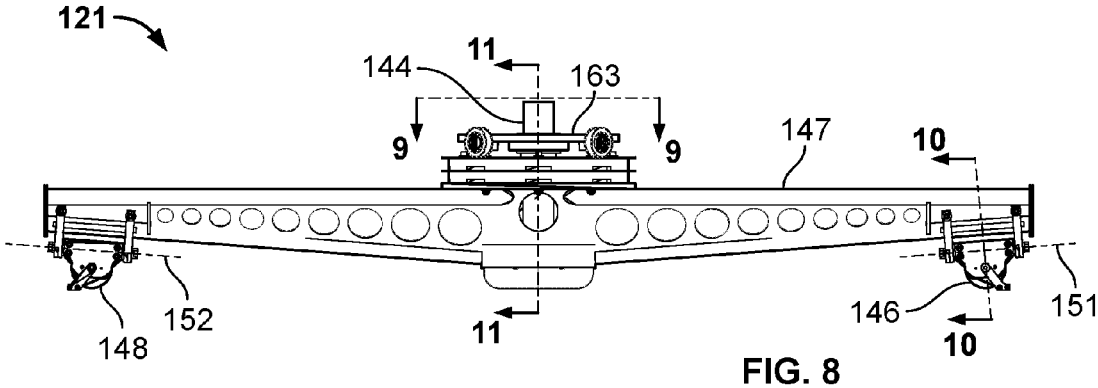
FIG. 8 shows a second portion of the load guidance apparatus of FIGS. 5-6 according to an exemplary embodiment of the disclosure.
Figure 9:
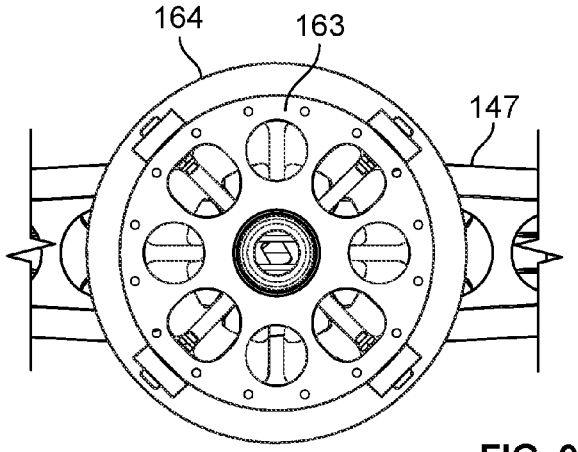
FIG. 9 shows an enlarged, partial view of the second portion of the load guidance apparatus of FIG. 8 according to an exemplary embodiment of the disclosure.
Figure 10:
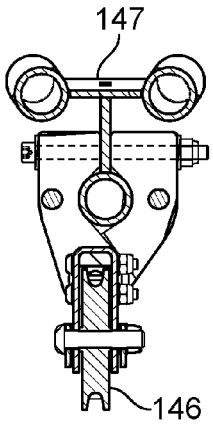
FIG. 10 shows a cross-section taken along line 10-10 from FIG. 8 according to an exemplary embodiment of the disclosure.
Figure 11:
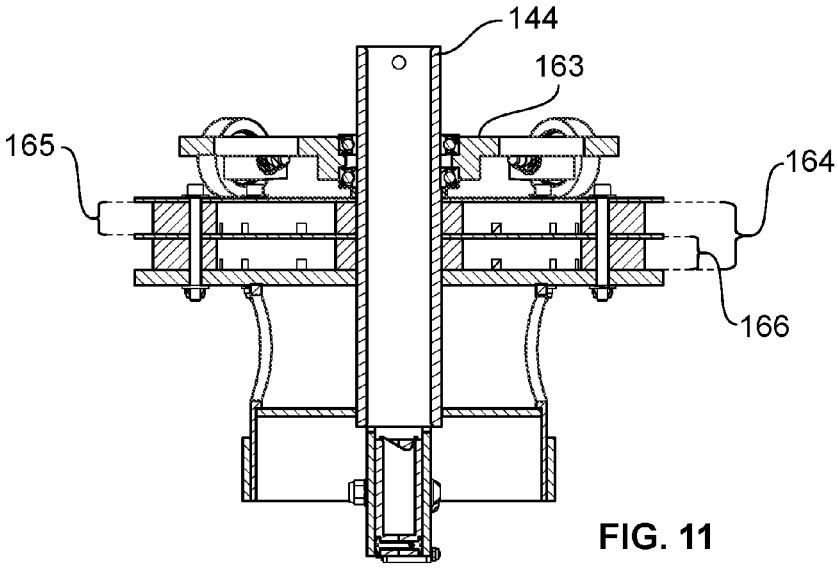
FIG. 11 shows a cross-section taken along line 11-11 from FIG. 8 according to an exemplary embodiment of the disclosure.

As further shown in the figures, load guidance apparatus 107 includes lift sheave assembly 140 (FIG. 1) securing a pair of sheaves 153, 155 associated with respective cables 207, 206. As shown in the exemplary embodiment, cables 207, 206 are associated with lifting a load, such as previously described in FIG. 4. To provide improved alignment with the positioning devices associated with cables 207, 206, respective sheaves 153, 155 include respective pivotable axes 154, 156. As further shown in the figures, after cables 207, 206 extend through and engage respective sheaves 153, 155, the cables are each redirected about a sheave 143 (FIGS. 5, 7) positioned above tube 144 (FIGS. 6, 7, 11) that extends inside of spacer 149 (FIG. 7). As further shown, cables 207, 206 are redirected about sheaves 143 through tube 144, and then redirected about respective sheaves 150 (FIGS. 6, 7) pivotably secured about respective sheave pins 145. Upon redirection about sheaves 150, cables 207, 206 are redirected about respective sheaves 146, 148 pivotably secured to arm 147 (FIG. 6) and then connected to the load. As further shown in FIG. 6, sheaves 146, 148 are pivotably secured about respective axes 151, 152, making possible a swinging motion of the load, in combination with movement of load guidance apparatus 107, if desired. Cables 207, 206 may be utilized to apply a lifting force (raising/lowering) of the load, as well as providing a rolling movement of the load as previously discussed, or in another embodiment, providing a pitch movement of the load as previously discussed, depending upon the application and/or preferences of the users.

As further shown in the figures, base 141, (FIGS. 5-7) which is part of first portion 120 of load guidance apparatus 107, includes shackles 142 for receiving respective cables 200, 201, 202, 203 that are each controlled by a positioning device as previously shown and discussed (not shown in FIGS. 5-11). In one embodiment, respective pull directions 117 by cables 200, 201, 202, 203 may be utilized for areal control of load guidance apparatus 107 within a working space. In another embodiment, as previously discussed, respective pull directions 117 by cables 200, 201, 202, 203 may be utilized to further controllably limit the travel/positioning of load guidance apparatus 107 within an upper portion of the working space.

As further shown in the figures, base 141 further includes sheaves 157, 159 having respective pivotable axes 158, 160, which sheaves are configured to receive respective cables 204, 205. As shown in FIGS. 5, 7, sheave 157, which is connected to base 141 (FIG. 7), redirects cable 204 around drum portion 166 of drum assembly 164. In one embodiment, after wrapping cable 204 around drum portion 166 in one direction, such as counterclockwise, as viewed from above load guidance apparatus 107, cable 204 may be secured to the load guidance apparatus such as by extending a loop (not shown) around tube 144 positioned inside of drum 164. Similarly, as shown in FIGS. 5, 6, sheave 159, which is connected to base 141 (FIG. 6), redirects cable 205 around drum portion 165 of drum assembly 164. In one embodiment, after wrapping cable 205 around drum portion 165 in one direction, such as clockwise as viewed from above load guidance apparatus 107, i.e., in a direction opposite that of cable 204 around drum portion 166, cable 205 may be secured to the load guidance apparatus such as by extending a loop (not shown) around tube 144 positioned inside of drum 164. As a result of controlled forces or pull directions 117 exerted by cables 204, 205 (from respective positioning devices), and by virtue of roller assembly 163, in response to a sufficient difference in the magnitude of pull directions 117, second portion 121 is urged into rotational movement with respect to first portion 120 about a common longitudinal axis (tube 144), resulting in a rotation of arm 147 about the longitudinal axis of tube 144. As shown in the figures, such rotation of arm 147 results in a yaw rotational movement of the load.

While only certain features and embodiments of the invention have been shown and described, many modifications and changes may occur to those skilled in the art (for example, variations in sizes, dimensions, structures, shapes and proportions of the various elements, values of parameters (for example, temperatures, pressures, etc.), mounting arrangements, use of materials, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A flying rig system comprising:

a load guidance apparatus;

at least two first positioning devices operatively connected to the load guidance apparatus to control the areal position of the load guidance apparatus within an upper portion of a working space;

a second positioning device operatively connected to the load guidance apparatus to permit selective vertical positioning of a load suspended from the load guidance apparatus substantially beneath the upper portion of the working space.

2. The system of claim 1, wherein the upper portion is substantially planar.

3. The system of claim 1, wherein the second positioning device is operatively connected to the load guidance apparatus to selectively control a pitch orientation angle of the load.

4. The system of claim 1, wherein the second positioning device is operatively connected to the load guidance apparatus to selectively control a roll orientation angle of the load.

5. The system of claim 1, wherein a third positioning device is operatively connected to the load guidance apparatus to selectively control a yaw orientation angle of the load.

6. The system of claim 1, wherein at least one of the first positioning devices is fixedly positioned during operation of the system.

7. The system of claim 1, wherein at least one of the first positioning devices is movably positionable during operation of the system.

8. The system of claim 1, wherein the load guidance apparatus is configured to selectably facilitate a swinging motion of the load during operation of the system.

9. The system of claim 1, wherein the load guidance apparatus includes a first portion and a second portion independently rotatable with respect to each other about a common axis.

10. The system of claim 9, wherein the first portion is operatively connected to the first positioning devices.

11. The system of claim 9, wherein at least one of the first portion and the second portion are operatively connected to the second positioning device.

12. The system of claim 9, wherein at least one of the first portion and the second portion are operatively connected to the third positioning device.

13. A method for positioning and orienting a load within a working space comprising:

providing a load guidance apparatus;

connecting at least two first positioning devices to the load guidance apparatus to control the areal position of the load guidance apparatus within an upper portion of a working space;

connecting a second positioning device to the load guidance apparatus to permit selective vertical positioning of a load suspended from the load guidance apparatus beneath the upper portion of the working space.

14. The method of claim 13, wherein connecting the second positioning device to the load guidance apparatus permits selective control of a pitch orientation angle of the load.

15. The method of claim 13, wherein connecting the second positioning device to the load guidance apparatus permits selective control of a roll orientation angle of the load.

16. The method of claim 13, further including connecting a third positioning device to the load guidance apparatus to permit selective control of a yaw orientation angle of the load.

17. The method of claim 13, wherein the load guidance apparatus is configured to selectably facilitate a swinging motion of the load during operation of the system.

18. The method of claim 13, wherein the upper portion is substantially planar.

19. The method of claim 13, wherein at least one of the positioning devices is fixedly positioned during operation of the system.

20. The method of claim 13, wherein at least one of the positioning devices is movably positionable during operation of the system.

21. The method of claim 13, wherein the load guidance apparatus includes a first portion and a second portion independently rotatable with respect to each other about a common axis.

* * * * *